United States Patent [19]

Hayward

[11] Patent Number: 4,681,390

[45] Date of Patent: Jul. 21, 1987

[54] NON-RADIATING COAXIAL OUTLET

[75] Inventor: Robert D. Hayward, Phoenix, Ariz.

[73] Assignee: Gilbert Engineering Company, Inc., Del.

[21] Appl. No.: 887,439

[22] Filed: Jul. 21, 1986

[51] Int. Cl.[4] ..... H01R 17/18

[52] U.S. Cl. ..... 439/578; 439/787

[58] Field of Search ..... 339/177, 143 R, 242, 339/243, 248 R, 248 S; 333/32–35, 246, 260, 206, 12, 210

[56] References Cited

U.S. PATENT DOCUMENTS

| | | | |
|---|---|---|---|
| 3,445,794 | 5/1969 | O'Keefe et al. | 333/260 |
| 3,594,663 | 7/1971 | Allen | 333/206 |
| 3,873,785 | 3/1975 | Lieberman | 333/260 |
| 4,110,716 | 8/1978 | Nekitas | 333/260 |
| 4,231,003 | 10/1980 | Ishimiru | 333/260 |
| 4,559,506 | 12/1985 | Capek | 333/206 |

*Primary Examiner*—Gil Weidenfeld
*Assistant Examiner*—David Pirlot
*Attorney, Agent, or Firm*—Don J. Flickinger; Jordan M. Meschkow

[57] ABSTRACT

A coaxial cable coupler is disclosed which includes a first section for coupling to the coaxial cable of a utilization device and a second section for coupling to the coaxial cable of a communications system. Both the first and second sections are provided with cavities therein. The cavity in the second section houses an insulating sleeve which in turn encloses a contact assembly for making contact to and electrically connecting the inner conductors of the coaxial cables of the communications system and utilization device. The first cavity is dimensioned and configured to function as a waveguide having a cutoff wavelength which is substantially below the operating wavelength spectrum of the system, thereby establishing a very deep bidirectional high pass filter at the open coupler. As a result, when the utilization device is disconnected, radiation from or to the coupler is prevented to thereby prevent environmental electromagnetic pollution and unauthorized wireless access from and to the system.

14 Claims, 4 Drawing Figures

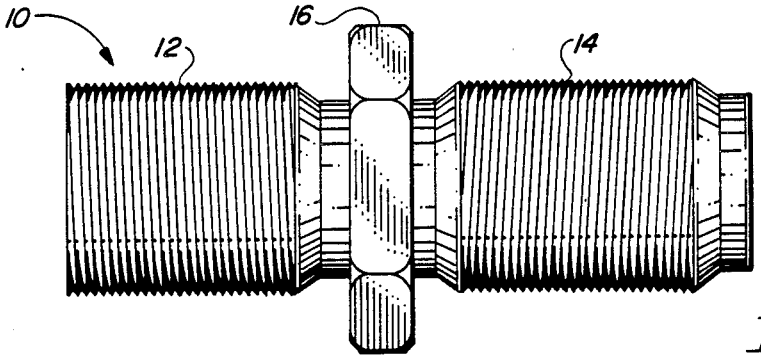
FIG. 1
FIG. 2A
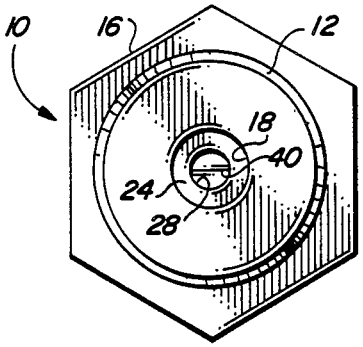
FIG. 2B
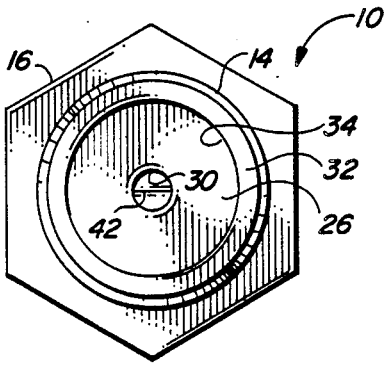
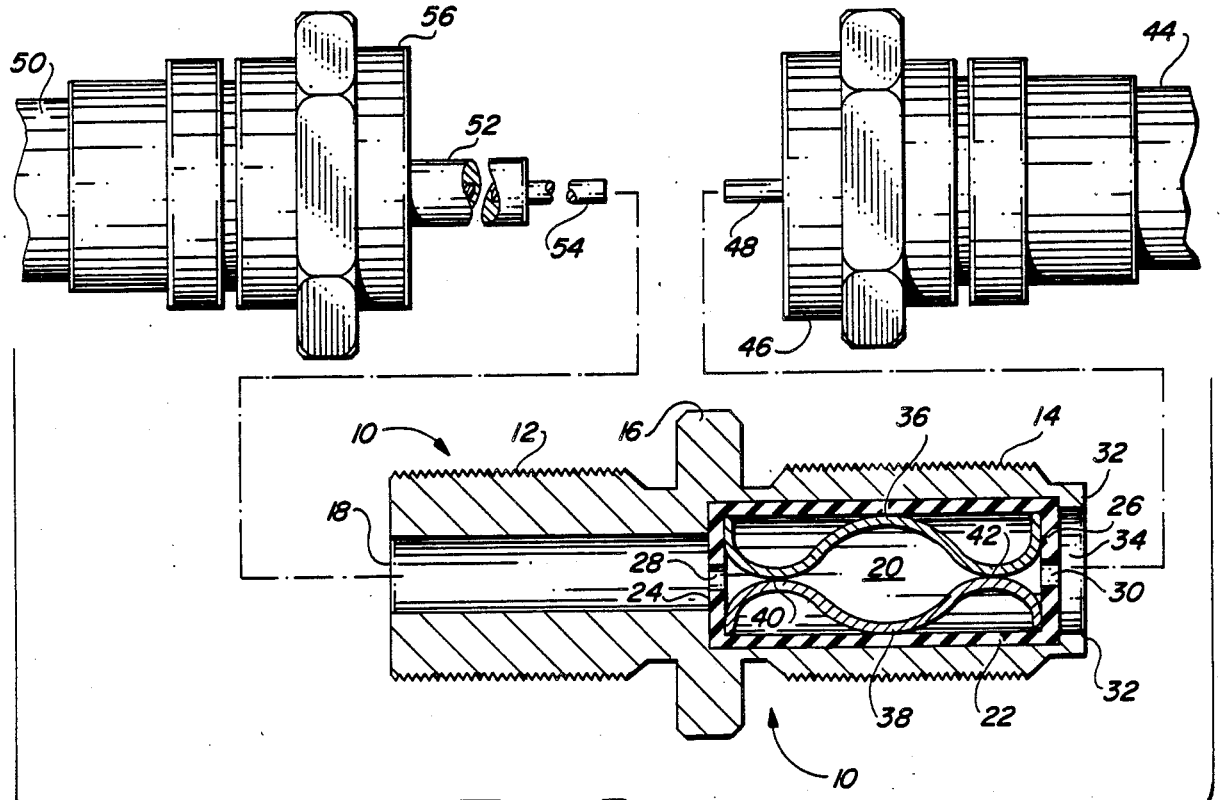
FIG. 3

NON-RADIATING COAXIAL OUTLET

BACKGROUND OF THE INVENTION

1. Field of the Invention

This invention relates to the coaxial cable communications art.

More particularly, the present invention relates to signal coupling outlets of the type to which terminating mechanisms or user devices are removably coupled into a system, employing coaxial cables to effect communications between the system constituents.

In a further and more specific aspect, the instant invention concerns an improved outlet especially adapted for deep signal attenuation upon disconnection of a normally connected user terminating device.

2. Background Information

It is common practice in coaxial cable communications systems for a plurality of terminating mechanisms to be coupled with a central signal processing unit. Exemplary is the familiar community antenna television (CATV) in which a single antenna is employed to receive an airborne signal and associated circuitry is employed to subsequently retransmit the signal, via coaxial cable, to the several monitors in the system. Also representative is the local area network (LAN) typified by a centralized data processing unit which communicates with one or more remotely located computer terminals.

Commonly, signals are coupled between the central unit and each remote device (and in certain installations, among the several remote devices) by means of coaxial cables. A drop line, typically a coaxial cable extending from the main or trunk line, terminates with an outlet in the vicinity of the respective remote device. The device is coupled into the system by means of an integral coaxial cable fitted with a connector which is detachably coupleable with the outlet.

The remote devices used in such systems may be generally characterized as being somewhat portable. Thus, for various reasons including maintenance, relocation or discontinuation of need, a particular device may be periodically or permanently withdrawn from service and removed from the system. Coincidentally, the connector is disengaged from the outlet.

Those skilled in the art will appreciate that low level system signals in the form of electromagnetic waves will radiate from an open, unterminated outlet thereby contributing to environmental electromagnetic interference. Recently, there has been an increased awareness and concern over the crowding of the electromagnetic spectrum threatening the environment with "electromagnetic pollution" as a result of the proliferation of electronic devices which function as electromagnetic interference sources. The desirability of securing an unused signal outlet to eliminate such radiation is therefore immediately apparent.

In addition, to maintain system integrity, it is imperative that each unused outlet be secured. In a CATV system, for example, the signal loss through an open outlet contributes to a general pollution of the communications spectrum and degraded performance of other devices, such as radios and television receivers, in the vicinity. Conversely, electromagnetic interference entering through an open outlet will cause distortion and effect other system degradations on other terminal devices still in use within the system.

The problem is of substantially greater significance in a local area network system, both as to radiation emission and reception. Frequently, an LAN system is intended to be available only to authorized personnel, and the signals occurring within the system may contain data and information which is proprietary or even of sufficient sensitivity as to affect the commercial or even national security. Similarly, the signals may require critical accuracy in the communications process. Unintentional or unauthorized reception of electromagnetic interference through an open outlet is capable of interrupting system operation and/or of altering or destroying the fidelity of transmissions and data. The open outlet also represents a potential serious breach of security since the radiating signal can be received by a remotely located unauthorized receptor. Further, the system itself may be deliberately accessed wirelessly through an open outlet to alter or destroy system information.

In attempting to remedy the foregoing problems, and to insure electromagnetic compatability, various purported solutions have been proposed in the prior art. A relatively uncomplicated and effective solution is in the form of a metal cap which is engaged with the outlet in lieu of the the removed cable connector. While effectively terminating the outlet, the cap device has been proven to be less than a satisfactory solution to the problem. As a result of inherent human foibles, especially when the primary concern is relocation of the terminal device, the act of placing the cap over the end of the outlet is frequently forgotten. Further, the cap (being relatively small) is easily lost. Also, if the cap is not properly attached, increased, rather than decreased, radiation can result. Finally, where unauthorized access to the system is sought, the cap may simply be surreptitiously removed.

To alleviate the problems associated with the above described cap, the prior art has provided self terminating outlets. Such devices generally include internal mechanisms which open upon the engagement of a connector and close upon disengagement. While being convenient to use, self-terminating outlets have not proven entirely effective in preventing radiation or reception of signals, either intentionally or unintentionally. Further, being relatively cumbersome and expensive to manufacture, the internal mechanism of such devices are subject to failure as a result of mechanical breakage or environmental deterioration such as the deposit of oxide layers which can defeat the self-terminating effect.

Thus, those skilled in the art will appreciate that it would be highly advantageous to remedy the foregoing and other deficiencies inherent in the prior art and to provide a very effective, yet simple, solution to the problem of terminating coaxial conductors to prevent communication to and from the open outlet when a user device has been removed.

SUMMARY OF THE INVENTION

Accordingly, it is an object of the present invention to provide improved outlet or coupler of the type especially adapted for use in a coaxial cable communications system.

Another object of the invention is the provision of an outlet in which the signal is inherently attenuated in the absence of engagement with a terminal device.

And another object of this invention is to provide an outlet which functions as an effective barrier for electromagnetic interference and which achieves electromagnetic compatability while concurrently providing immediate access for connection of a terminal device.

Still another object of the invention is the provision of an outlet which is exceedingly unencumbered and without intricate internal mechanisms or separable components.

Yet another object of the instant invention is to provide a self-attenuating outlet which is relatively uneffected by the normal ambient atmosphere and not subject to failure as the result of corrosion, oxidation, erosion, or other normally deleterious effects.

Yet another object of the invention is the provision of a device having intrinsic characteristics functioning as inordinately effective isolation between the internal coaxial environment and the external electromagnetic environment.

And a further object of the immediate invention is to provide an outlet having a shielding effectiveness exceeding that of the sheath of a conventional coaxial cable.

Yet a further object of this invention is the provision of an ameliorated outlet which is readily and conveniently retrofitted to preexisting conventional systems utilizing standard tools and techniques of the art.

Still a further object of the invention is to provide an improved outlet which is fabricated to be compatible with any selected standard coaxial interface.

And still a further object of the invention is the provision of a device of the foregoing character which is simply and economically manufactured and particularly maintenance free.

Briefly, these and other objects of the invention are achieved by providing a coaxial outlet or coupler including first and second axially aligned sections and in which centrally disposed spring contact means are provided in the second section for receiving and electrically coupling the center conductors of both a coaxial cable communicating with a central system and a coaxial cable coupling a terminal device to the central system. The first section includes a coaxially disposed cylindrical cavity extending along its length and disposed such that the center conductor and the surrounding dielectric insulation of a coaxial cable from a terminal device extends through the cavity to couple the center conductor with the aforementioned spring contact means. When the coaxial cable to the terminal device is decoupled from the connector, the coaxial cylindrical cavity becomes a circular waveguide having a cutoff frequency dependent upon its physical diameter and length dimensions. The diameter and length of the cavity are selected to obtain a cutoff frequency which is much higher than any frequency having meaning within the central system. The cavity, therefore, functions as a very abrupt and deep high pass only filter having a cutoff frequency far above the system signals. As a result, the waveguide acts as an extremely effective filter against communications from or to the system through the connector end left open upon removal of a terminal device.

BRIEF DESCRIPTION OF THE DRAWINGS

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 1 is a side view of one exemplary embodiment of the inventive non-radiating coaxial transmission line coupler, particularly illustrating that its outward appearance is conventional;

FIGS. *2a* and *2b* are first and second end views of the exemplary connector shown in FIG. 1; and FIG. 3 is a cross sectional view of the exemplary inventive coupler shown in FIG. 1 indicating how, for the exemplary embodiment, a coaxial cable transmission line system and terminal may be detachably coupled by and particularly illustrating the physical configuration effecting a circular waveguide obtained when the user device is removed from the system.

DETAILED DESCRIPTION OF THE PREFERRED EMBODIMENTS

Referring now to FIG. 1, it will be seen that an exemplary embodiment of the inventive non-radiating coaxial cable coupler (which may typically be a wall outlet) comprises a conductive metal housing 10 which includes a first longitudinal section 12 and a second longitudinal section 14 with an intermediate hexagonal gripping portion 16. In the exemplary embodiment, first section 12 and second section 14 are each externally threaded, and those skilled in the art will immediately recognize that, insofar as external appearance is concerned, the housing 10 has the appearance (and as will become more evident below, shares the same function as) a conventional F-81 coaxial connector for coupling a pair of 75 ohm coaxial cables. It is important to appreciate that the several figures herein illustrate only an exemplary embodiment of the invention which is equally applicable to other coaxial cable couplers, connectors and outlets which may have friction fit, bayonet, interrupted thread, C-ring or any other of the conventional and well-known coupling standard configurations for connecting two or more coaxial cables.

As shown in the several figures and particularly FIG. 3, a first coupler section 12 includes an internal coaxial cylindrical bore 18 which extends therethrough and connects with a cylindrical cavity 20 all disposed within the second longitudinal section 14. Thus, the cylindrical cavities 20 and 18 are coaxially aligned and merge at their meeting place.

Unlike the cavity 18, however, the cavity 20 is providing with an insulating sleeve comprising a cylindrical sidewall 22 and end walls 24 and 26 which have coaxially aligned apertures 28 and 30, respectively, therethrough. The insulating sleeve is retained within the cavity 20 by lip portion 32 which defines a central coaxial opening 34 at the free end of second section 14. Disposed within the insulating sleeve are first and second leaf springs 36 and 38, respectively, which together form a spring dual center conductor receiving assembly. (Alternatively, springs 36 and 38 may be unitary.) The springs 36 and 38 (which may be of the well-known beryllium-copper or phosphor bronze spring materials noted for their elastic and conductive properties) substantially abut at regions 40 and 42 which are approximately aligned with the apertures 28, 30. Externally threaded second section 14 is adapted to be coupled to a central system by means of a coaxial cable 44 which is terminated by a conventional internally threaded coaxial connector 46. That is, internally threaded connector 46 (electrically corresponding to the outer braid conductor of coaxial cable 44) may be threadedly engaged with the external threads of connector section 14. In so doing, the center conductor 48 of the coaxial cable 44 is received through the opening 34 and aperture 30 to slightly urge apart leaf springs 36 and 38 in the region 42 apart, thus making secure electrical contact therewith.

Similarly, a utilization device, such as a computer terminal or television set, may be removably coupled to externally threaded section 12 via a coaxial cable 50 terminating in an internal threaded coaxial connector 56 which electrically corresponds to the outer braid conductor of coaxial cable 50. Thus, the outer braid conductors of the coaxial cables 44, 50 are electrically directly connected by the housing 10. The center conductor 54 of the coaxial cable 50 and the surrounding dielectric insulation of 52 are trimmed to have respective lengths such that, when internally threaded connector 56 is threaded onto externally threaded section 12, the center conductor 54 will extend through the aperture 28 into the region 40, thus urging leaf springs 36 and 38 apart and establishing direct electrical contact (through the leaf springs 36, 38) with the center conductor 48 of coaxial cable 44. In that position, the cutaway end of the dielectric 52 will preferably reside near the end wall 24 of the insulating sheath disposed within the section 14. It will be noted that the diameter of the coaxial cavity 18 in the section 12 is just sufficient to freely admit the dielectric insulation 52 surrounding the center conductor 54 of coaxial cable 50.

Consider now the electromagnetic circuit configuration when the central system is in operation and the coaxial cable 44 remains coupled to the second section 14 of the coupler housing 10 (which may be situated, e.g., as a wall outlet) and the connector 56 of the coaxial cable 50 has been withdrawn from the first section 12 to permit removal of the terminal device (not shown) through which the coaxial cable 50 has provided communication with the central system. It will be seen that, under those conditions, the cylindrical coaxial circular passage 18 extending through the length of the first section 12 can be deemed a waveguide. Waveguides have remarkably steep high pass cutoff characteristics which are dependent upon an individual waveguide's physical dimensions.

More particularly, when a waveguide is used at a wavelength greater than the cutoff wavelength, there is no real propogation and the fields ae attenuated exponentially. The attenuation L in a length d is given by:

$$L=54.5(d/\lambda_c)[1-(\lambda_c/\lambda)^2]^{\frac{1}{2}} \text{ decibels}$$

where $\lambda_c$ equals the cutoff wavelength and $\lambda$ equals the operating wavelength. Further, where $\lambda$ is much greater than $\lambda_c$ attenuation becomes essentially independent of frequency and the following simplification may be employed:

$$L=54.5d/\lambda_c \text{ decibels}$$

where $\lambda_c$ is a function of the waveguide geometry. For a circular waveguide, $\lambda_c$ equals 2.613 times the radius of the waveguide.

Consider now a specific example in which the length of the first section 12 is 0.50 inches and the diameter of the cylindrical cavity 18 is 0.16 inches.

$$\lambda_c=2.613\times0.08=0.209 \text{ inches}$$

Thus, the attenuation for wavelengths much longer than $\lambda_c$ is given by:

$$L=54.5\times(0.5/0.209)=130 \text{ decibels}$$

Since the wavelength criteria are met (i.e., the exemplary dimensions are as given and the highest frequency signals present in the spectrum of the central system are much lower than the calculated cutoff frequency of the cavity 18), 130 db attenuation is presented by the first section 12 to and external to the system when the coaxial cable 50 is disconnected, and this attenuation is effective as to electromagnetic radiation out of or into the central system at the coupler. It will be apparent, of course, that more or less than 130 db of attenuation may be obtained by correspondingly adjusting the length and diameter dimensions of the cavity 18. However, 130 db is an exceedingly deep attenuation (exceeding even that obtained by the shielding of the outer braid along the length of a coaxial cable) which places electromagnetic radiation from the open coupler into the ambient electromagnetic noise and indistinguishable therefrom. Conversely, access to the system by wireless means through the open coupler would require an extremely powerful and very close by transmitter to obtain access to the system. As a practical matter, such access becomes impossible.

The bases and derivations of the above-discussed equations are set forth in standard reference works on the subject. See, for example, Chapter 25 in *Reference Data for Radio Engineers* (sixth edition, 1975) published by Howard W. Sams and Co., Indianapolis, Ind.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

Having fully described and disclosed the present invention and alternately preferred embodiments thereof in such clear and concise terms as to enable those skilled in the art to understand and practice the same, the invention claimed is:

1. A non-radiating coaxial cable coupler for connecting a terminal device to a system, said system and said device being coupled to first and second coaxial cables, respectively, each said first and second coaxial cables having concentric inner and outer conductors, said coupler comprising:

a. first and second longitudinally aligned coaxial sections;

b. said first section adapted for coupling to the first coaxial cable and having a first cavity therein;

c. insulating means positioned within said first cavity;

d. contact means disposed within said insulating means for detachably receiving and contacting the inner conductors of the first and second coaxial cables; and e. said second section adapted for coupling to said second coaxial cable and having a second cavity therein, said second cavity being dimensioned and configured to act as a waveguide having a cutoff wavelength substantially below the wavelength spectrum of said system;

whereby there is substantially no electromagnetic radiation from or into said coupler when said second cable is not coupled thereto.

2. A coupler according to claim 1 wherein said first cavity is adjacent and longitudinally aligned with said second cavity.

3. A coupler according to claim 1 wherein said second cavity is cylindrical.

4. A coupler according to claim 3 wherein said first cavity is adjacent and longtudinally aligned with said second cavity.

5. A coupler according to claim 4 wherein said first cavity is cylindrical and said insulating means comprise an insulating sleeve having a side wall and first and second end walls, each said end wall having an aperture therethrough.

6. A coupler according to claim 5 wherein said contact means comprise first and second resilient means which contact each other at first and second regions for receiving the respective inner conductors of the first and second coaxial cables.

7. A coupler according to claim 6 wherein said first and second resilient means are first and second curved leaf springs.

8. A coupler according to claim 7 wherein said first and second sections are externally threaded.

9. A coupler for coupling together first and second coaxial cables each having inner and outer conductors comprising:

a. a first section for coupling to the outer conductor of said first coaxial cable and having a first cavity therein;

b. a second section coaxially aligned with said first section for coupling to the outer conductor of said second coaxial cable and having a second cavity therein, said second cavity being dimensioned and configured to act as a waveguide having a predetermined cutoff wavelength; and c. contact means within said first cavity for contacting and electrically connecting the inner conductors of said first and second coaxial cables.

10. A coupler according to claim 9 further comprising insulating means positioned within said first cavity within which said contact means is positioned to insulate said contact means from said first section.

11. A coupler according to claim 10 wherein said insulating means is an insulating sleeve having a side wall and first and second end walls, each end wall having an aperture therethrough.

12. A coupler according to claim 11 wherein said contact means comprise first and second resilient means which contact each other at first and second regions for receiving the respective inner conductors of the first and second coaxial cables.

13. A coupler according to claim 12 wherein said first and second sections and said first and second cavities are cylindrical.

14. A coupler according to claim 13 wherein said first and second sections are externally threaded.

* * * * *